US008287120B2

(12) United States Patent
Murata et al.

(10) Patent No.: US 8,287,120 B2
(45) Date of Patent: Oct. 16, 2012

(54) RECORDING APPARATUS

(75) Inventors: Satoshi Murata, Okazaki (JP); Shigeki Kato, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 393 days.

(21) Appl. No.: 12/749,403

(22) Filed: Mar. 29, 2010

(65) Prior Publication Data

US 2011/0050825 A1 Mar. 3, 2011

(30) Foreign Application Priority Data

Aug. 31, 2009 (JP) ..... 2009-200639

(51) Int. Cl.
*B41J 2/01* (2006.01)

(52) U.S. Cl. ..... 347/104; 347/101

(58) Field of Classification Search ..... None
See application file for complete search history.

(56) References Cited

U.S. PATENT DOCUMENTS

| | | | | |
|---|---|---|---|---|
| 5,136,307 | A * | 8/1992 | Uchida et al. | 346/136 |
| 5,531,436 | A | 7/1996 | Ohyama et al. | |
| 7,784,891 | B2 * | 8/2010 | Kumagai | 347/8 |
| 2002/0009319 | A1 * | 1/2002 | Tanno et al. | 400/118.2 |
| 2002/0021312 | A1 * | 2/2002 | Matsumoto | 347/1 |
| 2005/0128275 | A1 * | 6/2005 | Uji et al. | 347/104 |
| 2005/0195264 | A1 * | 9/2005 | Sootome et al. | 347/104 |
| 2005/0270355 | A1 * | 12/2005 | Sootome et al. | 347/104 |
| 2006/0261298 | A1 * | 11/2006 | Matsumoto | 250/590 |
| 2006/0263113 | A1 * | 11/2006 | Matsumoto | 399/164 |
| 2007/0035605 | A1 * | 2/2007 | Kitahara | 347/104 |
| 2009/0167814 | A1 | 7/2009 | Sugimoto et al. | |

FOREIGN PATENT DOCUMENTS

| | | | |
|---|---|---|---|
| EP | 0693381 | A1 | 1/1996 |
| JP | H07-137877 | A | 5/1995 |
| JP | H07-330185 | A | 12/1995 |
| JP | 2006-035635 | A | 2/2006 |
| JP | 2007-230035 | A | 9/2007 |
| JP | 3139539 | U | 2/2008 |
| JP | H03-139539 | U | 2/2008 |
| JP | 2009-154360 | A | 7/2009 |

* cited by examiner

*Primary Examiner* — Stephen Meier
*Assistant Examiner* — Leonard S Liang
(74) *Attorney, Agent, or Firm* — Baker Botts L.L.P.

(57) ABSTRACT

A recording apparatus, includes: a record head having an image formation surface which forms an image on a recording medium; a conveyance belt which conveys the recording medium to a position to face the image formation surface; a media attracting platen having a pair of electrodes, which is disposed in such a manner that the conveyance belt is sandwiched between the media attracting platen and the image formation surface; a voltage supply unit which applies a voltage to the pair of electrodes so as to attract the recording medium to the conveyance belt; and a transport unit which moves at least one of the conveyance belt and the media attracting platen so that a spacing distance between the conveyance belt and the media attracting platen is selectively switched between a first distance and a second distance longer than the first distance.

14 Claims, 10 Drawing Sheets

MAIN SCANNING DIRECTION
SUB SCANNING DIRECTION

MAIN SCANNING DIRECTION
SUB SCANNING DIRECTION

RECORDING APPARATUS

CROSS REFERENCE TO RELATED APPLICATION

The present application claims priority from Japanese Patent Application No. 2009-200639, which was filed on Aug. 31, 2009 the disclosure of which is herein incorporated by reference in its entirety.

BACKGROUND OF THE INVENTION

As an example of a known recording apparatus, there has been an ink jet printer having: a conveyance belt looped around three rollers which are a drive roller, a driven roller, and a tension roller; a conveyance roller which is biased towards the driven roller and which conveys a sheet (recording medium) sandwiched between the conveyance roller and the conveyance belt; and an electrostatic attraction force generator disposed between the drive roller and the driven roller, which generates an electrostatic attraction force on the conveyance belt.

In this ink-jet printer, the electrostatic attraction force generator has a comb shaped electrode plate and an earth plate. With application of voltage to the electrode plate, an electrostatic attraction force is generated on the conveyance belt. This electrostatic attraction force attracts, to the conveyance belt, a sheet sandwiched by the conveyance belt and the conveyance roller while the sheet is conveyed to an area where the sheet faces a record head which then forms an image on the sheet.

SUMMARY OF THE INVENTION

However, in the ink-jet printer, the conveyance belt and the attraction force generator may stick to each other with a large attraction force, particularly when conveyance of a sheet is stopped while the sheet is attracted to the conveyance belt; e.g., when a jam occurs. The attraction force which is a Johnsen-Rahbek force generated by the electrostatic attraction force generator increases with an increase in the value of the current flowing between the electrode plate and the earth plate. While the sheet is stuck on the conveyance belt, a relatively large current flows in the route which goes through the electrode plate→the conveyance belt→the sheet→the conveyance belt→the earth plate becomes relatively large, thus generating a large attraction force between the conveyance belt and the electrostatic attraction force generator. If the conveyance belt moves relative to the electrostatic attraction force generator, the conveyance belt and the electrostatic attraction force generator do not stick to each other despite the large attraction force generated therebetween. However, when the conveyance belt stops due to the above mentioned jam or the like, the conveyance belt and the electrostatic attraction force generator stick to each other due to the charge accumulated on the surfaces of the conveyance belt and the electrostatic attraction force generator which face each other. This charge is not discharged in a short period of time even if application of voltage to the electrode plate is stopped. Therefore, once the conveyance belt sticks to the electrostatic attraction force generator, a significantly great initial running load is required to resume running of the conveyance belt. Attempting to forcedly run the conveyance belt however may stretch or damage the conveyance belt, or cause the conveyance belt to slip on the drive roller (belt roller).

In view of the above, it is an object of the present invention to provide a recording apparatus which requires less initial running load of the conveyance belt.

To achieve the object, a recording apparatus of the present invention includes: a record head having an image formation surface which forms an image on a recording medium; a conveyance belt which conveys the recording medium to a position to face the image formation surface; a media attracting platen having a pair of comb-shaped electrodes, which is disposed in such a manner that the conveyance belt is sandwiched between the media attracting platen and the image formation surface; a voltage supply unit which applies a voltage to the pair of comb-shaped electrodes so as to attract the recording medium to the conveyance belt; and a transport unit which moves at least one of the conveyance belt and the media attracting platen so that a spacing distance between the conveyance belt and the media attracting platen is selectively switched between a first distance and a second distance longer than the first distance.

DESCRIPTION OF THE PREFERRED EMBODIMENTS

The following describes preferable embodiments of the present invention, with reference to the attached drawings.

Figure 1:
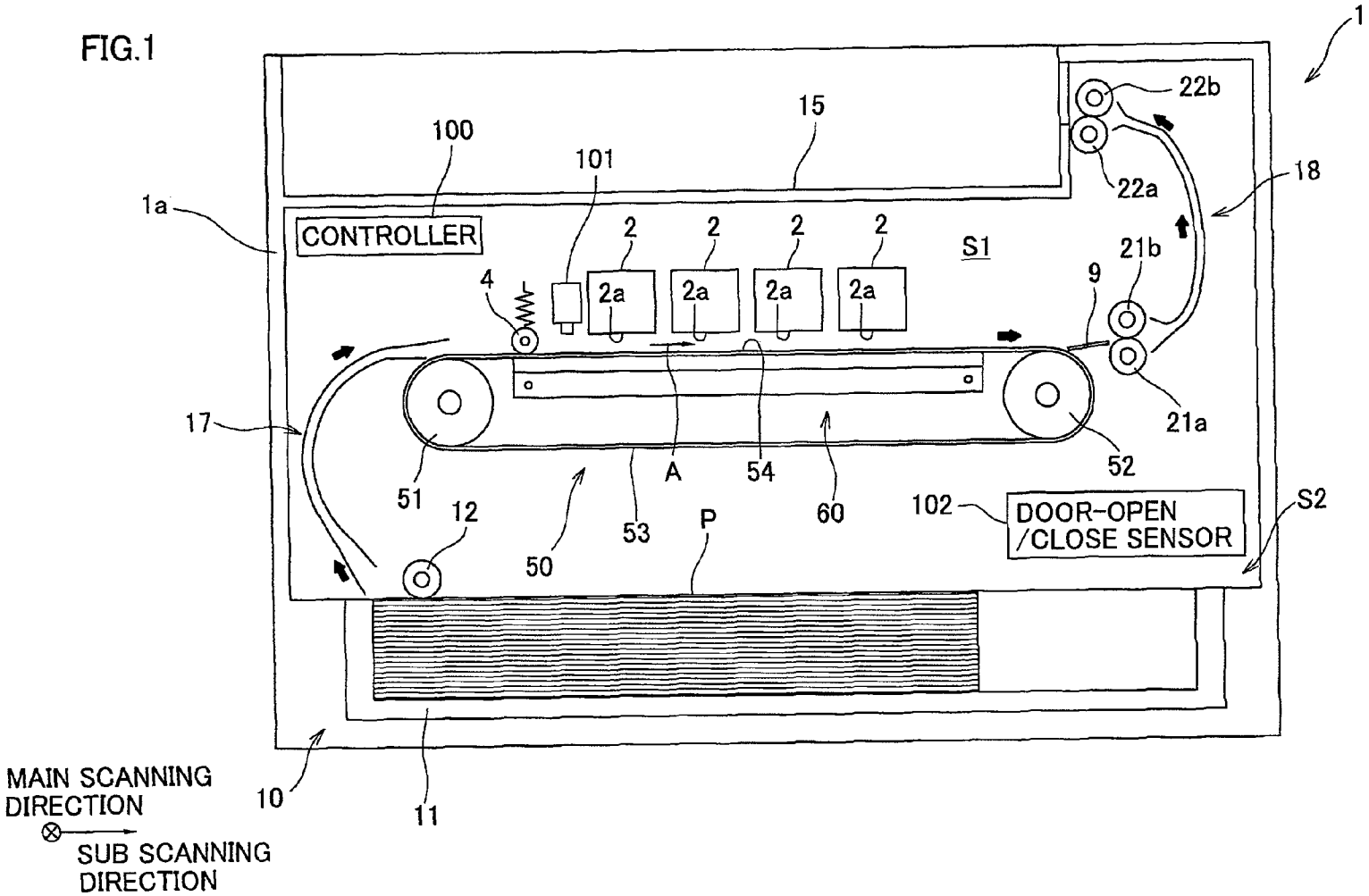
FIG. 1 is a schematic side view illustrating an inside structure of an ink-jet printer of a first embodiment, according to the present invention.

An ink-jet printer 1 of a first embodiment includes a casing 1*a* having a rectangular parallelepiped shape, and a sheet output unit 15 provided above the casing 1*a*, as illustrated in FIG. 1. The casing 1*a* includes therein two spaces S1 and S2 sequentially arranged in the top-to-bottom direction. In the space S1 are disposed four ink jet heads 2 and a conveyance mechanism 50 sequentially in the top-to-bottom direction. The four ink-jet heads 2 eject ink of Magenta, Cyan, Yellow, and Black, respectively. The conveyance mechanism 50 conveys a sheet P in a conveyance direction A. In the space S2 is disposed a sheet feeding unit 10. The ink-jet printer 1 further includes a controller 100 which controls the operation of these members. Note that, in the present embodiment, a direction parallel to the conveyance direction A in which the sheet P is conveyed by the conveyance mechanism 50 is hereinafter referred to as sub scanning direction. Further, a direction which perpendicularly crosses the sub scanning direction along a horizontal plane is hereinafter referred to as main scanning direction.

Inside the ink jet printer 1 is a sheet conveyance path in which a sheet P is conveyed from the sheet feeding unit 10 to the sheet output unit 15 as is indicated by the bold arrows in FIG. 1. The sheet feeding unit 10 has a sheet feeding cassette 11 capable of accommodating therein a stack of sheets P; a sheet feeding roller 12 which feeds out a sheet P from the sheet feeding cassette 11; and a sheet feeding motor which rotates the sheet feeding roller 12 under control of the controller 100.

The sheet feeding roller 12 feeds out the uppermost one of sheets P stacked and stored in the sheet feeding cassette 11. The conveyance mechanism 50 has a conveyance guide 17 which is curved and extended upwardly from the sheet feeding cassette 11 on the left side of FIG. 1.

In this structure, the sheet feeding roller 12 rotates clockwise in FIG. 1 under control of the controller 100, thereby feeding out the sheet P contacting the sheet feeding roller 12 to the conveyance mechanism 50 via the conveyance guide 17.

Figure 2A:
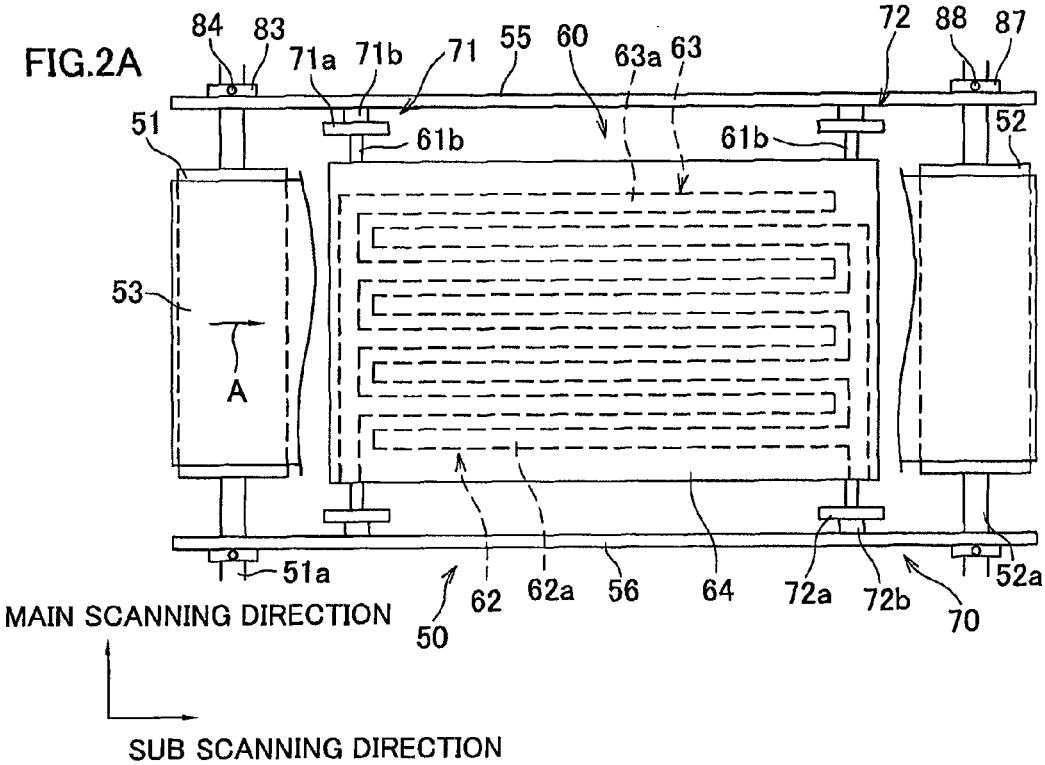
FIGS. 2A to 2C are a schematic diagram of a conveyance mechanism illustrated in FIG. 1.

The conveyance mechanism 50 is disposed so as to face the four ink jet heads 2 and includes: two belt rollers 51 and 52; an endless conveyance belt 53 looped around the two rollers 51 and 52; a conveyance motor which rotates a belt roller 52 under control of the controller 100; a media attracting platen 60; a moving mechanism (transport unit) 70 which moves the media attracting platen 60 in the upward or downward direction; and a pair of support plates 55 and 56 which support the belt rollers 51 and 52 and the moving mechanism 70, as illustrated in FIG. 1 and FIG. 2. The two belt rollers 51 and 52 are arranged parallel to each other in the conveyance direction A, and are rotatably supported by the support plates 55 and 56 via the axes 51*a* and 52*a*.

The conveyance belt 53 is flexible. For example, the conveyance belt 53 is made of polyimide or a fluorine resin, and has a volume resistivity of approximately $10^8$ to $10^{14}$ Ωcm. The material of the conveyance belt 53 is not particularly limited as long as the similar volume resistivity is achievable.

The media attracting platen 60 includes: a plate-like base member 61 made of an insulative material; two electrodes 62 and 63 adhered to a top surface 61*a*; and a protection film 64 adhered to the top surface 61*a* so as to cover the entire electrodes 62 and 63. These electrodes 62 and 63 have a plurality of lengthy parts 62*a* and 63*a*, respectively. These lengthy parts 62*a* and 63*a* extend parallel to the conveyance direction A, and form a comb shape in which the lengthy parts 62*a* and the lengthy parts 63*a* are alternately disposed in the main scanning direction. Further, the electrodes 62 and 63 are connected to a not-illustrated voltage supply unit provided inside the casing 1*a*. This voltage supply unit is controlled by the controller 100.

On two side surfaces of the base member 61 extending along the conveyance direction A, four cylindrical projections 61*b* projecting outwardly are provided at the upstream and downstream ends relative to the conveyance direction A. For example, the protection film 64 is made of polyimide or a fluorine resin, and has a volume resistivity of approximately $10^8$ to $10^{14}$ Ωcm. The material of the protection film 64 is not particularly limited as long as the similar volume resistivity is achievable.

Figure 2B:
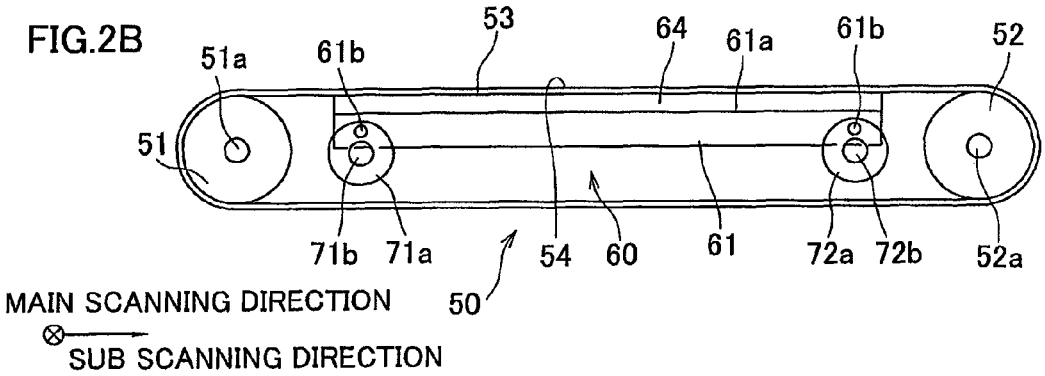
Figure 2C:
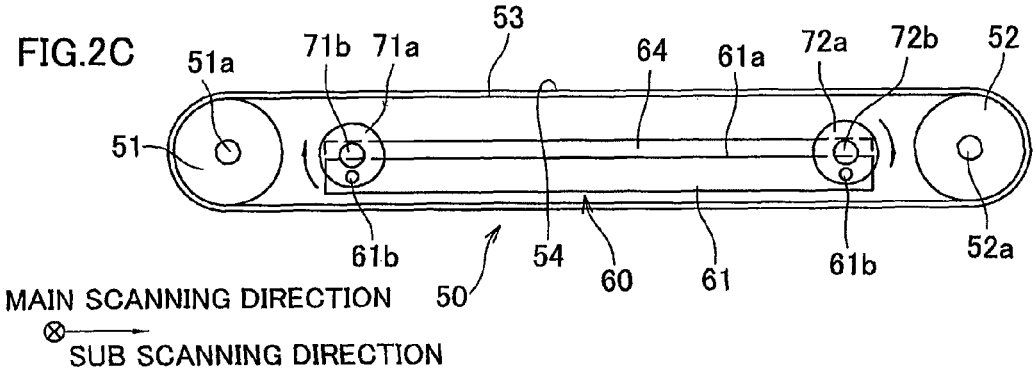

Further, the media attracting platen 60 is movable, in the upward or downward direction relative to the upper part of the loop (hereinafter, upper loop) of the conveyance belt 53, between the position illustrated in FIG. 2B and the position illustrated in FIG. 2C, with an aid of the moving mechanism 70. The position of FIG. 2B is a position where the media attracting platen 60 is close to the conveyance belt 53, and is a position taken when the sheet P is conveyed by the conveyance mechanism 50. This position of FIG. 2B is hereinafter referred to as approximated position. The position of FIG. 2C on the other hand is a position below the position of FIG. 2B, and is a position where the media attracting platen 60 is apart from the conveyance belt 53, as compared with the position of FIG. 2B. This position of FIG. 2C is hereinafter referred to as departed position.

The moving mechanism 70 has an upstream support member 71 which supports the upstream portion of the media attracting platen 60 relative to the conveyance direction; a downstream support member 72 which supports the downstream end of the media attracting platen 60 relative to the conveyance direction; and a drive mechanism. The drive mechanism has a drive motor controlled by the controller 100; and a transmission mechanism which transmits a rotation force from the drive motor to discs 71*a* and 72*a* at the same time.

The upstream support member 71 has two discs 71*a* which support the projections 61*b*. On each disc 71*a* is formed a hole which rotatably accommodates the projection 61*b* relative to the disc 71*a*. Further, the two discs 71*a* are rotatably supported on the support plates 55 and 56 via axes 71*b* projecting from the centers of the discs 72*a*. On the other hand, the downstream support member 72 also has two discs 72*a* similar to the discs 71*a*. The discs 72*a* are rotatably supported on the support plates 55 and 56 via axes 72*b*.

In this structure of the moving mechanism 70, when the discs 71*a* and 72*a* rotate under control of the controller 100, the top surface of the media attracting platen 60 moves relative to the back surface of the upper loop of the conveyance belt 53. While the media attracting platen 60 is in the approximated position of FIG. 2B, the top surface of the media attracting platen 60 and the back surface of the upper loop of the conveyance belt 53 are apart from each other by a first distance. That is, these two surfaces face each other with a gap of 5 μm for example therebetween. When the discs 71*a* and 72*a* rotate 180° from the position of FIG. 2B, the media attracting platen 60 descends from the approximated position of FIG. 2B to the departed position of FIG. 2C. The distance between the top surface of the media attracting platen 60 and the back surface of the upper loop of the conveyance belt 53 is then a second distance which is longer than the first distance. When the discs 71*a* and 72*a* rotate 180° in the same direction, the media attracting platen 60 returns from the departed position of FIG. 2C to the approximated position of FIG. 2B. Note that the media attracting platen 60 is moved from the approximated position to the departed position, at a time of maintenance operation in which maintenance work is performed to the media attracting platen 60 and the conveyance belt 53. That is, during the usual printing operation, the media attracting platen 60 is in the approximated position. Further, the media attracting platen 60 moves between the approximated position and the departed position, with the top surface thereof being kept horizontal.

While the media attracting platen 60 is in the approximated position and the spacing distance between the top surface of the media attracting platen 60 and the back surface of the upper loop of the conveyance belt 53 is the first distance, application of a voltage to the pair of comb-shaped electrodes 62 and 63 causes accumulation of charge between the media attracting platen 60 and the upper loop of the conveyance belt 53. On the other hand, while the medial attracting platen 60 is in the departed position where the spacing distance is the second distance, no charge is accumulated between the media attracting platen 60 and the upper loop of the conveyance belt 53 when a voltage is applied to the pair of comb-shaped electrodes 62 and 63, due to the long spacing distance. Further, even when charge is accumulated between the media attracting platen 60 and the upper loop of the conveyance belt 53 while the spacing distance is the first distance, the charge between the media attracting platen 60 and the upper loop of the conveyance belt 53 quickly returns to the state before the start of charge accumulation. This is because the change in the spacing distance to the second distance separates the media attracting platen 60 and the upper loop of the conveyance belt 53 farther than a distance in which the charge on the media attracting platen 60 and the charge on the upper loop of the conveyance belt 53 attract each other.

A nip roller 4 is disposed so as to face the lengthy parts 62*a* and 63*a* of the electrodes 62 and 63 at the upstream end of the media attracting platen 60. The nip roller 4 presses a sheet P fed out from the sheet feeding unit 10 against the conveyor surface 54. Above the conveyor surface 54 is provided a sheet detection sensor 101. The sheet detection sensor 101 senses whether or not a sheet is on the conveyor surface 54, and transmits the result to the controller 100.

In this structure, rotating the belt roller 52 clockwise in FIG. 1 under control of the controller 100 causes the conveyance belt 53 to run. With the rotation of the conveyance belt 53, the belt roller 51 and nip roller 4 also rotate. At this point, the different potentials are applied to the two electrodes 62 and 63 under control of the controller 100, respectively. For example, a positive or negative potential is applied to the electrode 62, and a ground potential is applied to the electrode 63.

Figure 3:
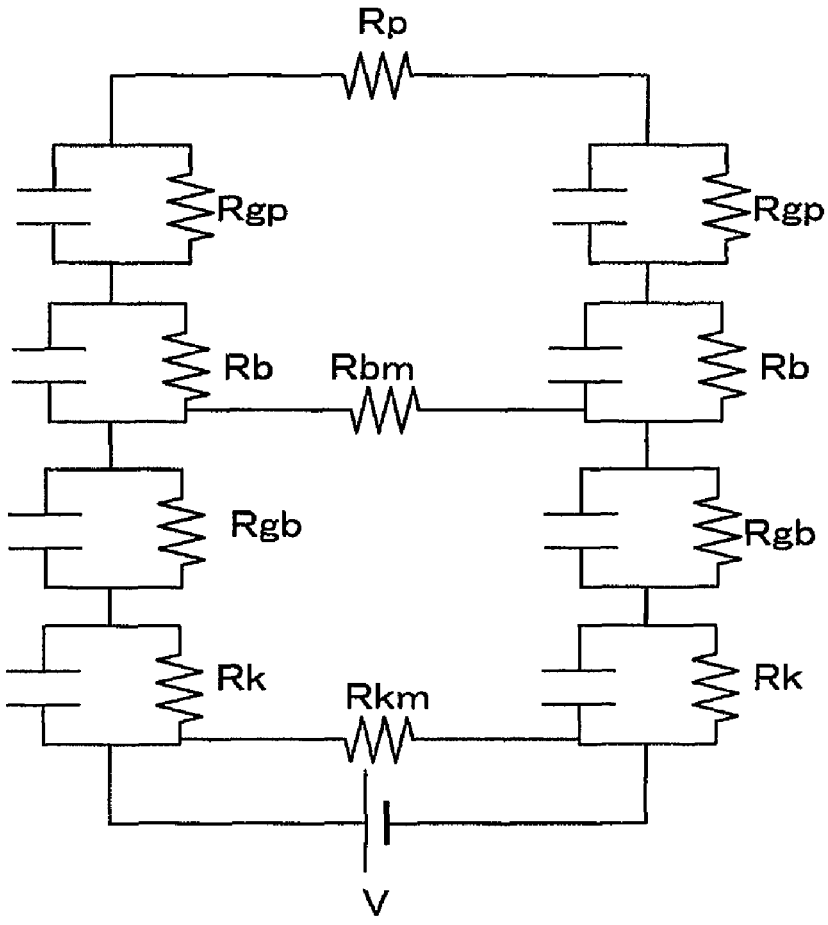
FIG. 3 illustrates an electric circuit formed in the conveyance mechanism illustrated in FIG. 2.

Application of a voltage to the electrodes 62 and 63 causes a flow of current between the electrodes 62 and 63 via the conveyance belt 53 and a sheet P. FIG. 3 illustrates an electric circuit in which a voltage V is applied to the electrodes 62 and 63. The electric circuit illustrated in FIG. 3 is no more than an example of models that could be conceived when idealizing the present embodiment in the form of electric structure.

This electric circuit includes a route going through the electrode 62→the conveyance belt 53→the sheet P→the conveyance belt 53→and the electrode 63. Rk, Rgb, Rb, Rgp, and Rp of FIG. 3 indicate the electric resistances along this route. Specifically, Rk, Rgb, Rb, Rgp, and Rp are respectively: an electric resistance of the protection film 64 between the electrodes 62 and 63 and the conveyance belt 53; an electric resistance at the gap between the protection film 64 and the conveyance belt 53; an electric resistance of the conveyance belt 53; an electric resistance of the gap between the conveyance belt 53 and the sheet P; and an electric resistance of the sheet P.

Further, this electric circuit includes an alternative routes connected in parallel to the above mentioned route. Rkm and Rbm indicate the electric resistances of this alternative route. Specifically, Rkm indicates the electric resistance of the alternative route directly connecting the electrodes 62 and 63 via the protection film 64 only. Rbm on the other hand indicates the electric resistance of an alternative route connecting the sides of electrode 62 and the electrode 63 via the conveyance belt 53 but not the sheet P.

The electric circuit includes capacitors connected in parallel, which are respectively formed for the electric resistances, as illustrated in FIG. 3. The respective surfaces of the sheet P and the conveyance belt 53 that face each other are made slightly irregular. Thus, a minute current flows in the gap between respective portions of the sheet P and the conveyance belt 53 contacting each other, when a voltage is applied between the electrodes 62 and 63. Thus, there will be a difference in the potential between the sheet P and the conveyance belt 53. In the area where the sheet P and the conveyance belt 53 do not contact each other, charges of different polarities are accumulated, and an attraction force by Coulomb force acts between the sheet P and the conveyance belt 53. This attraction force is so-called Johnsen-Rahbek force. With this, the sheet P on the conveyance belt 53 is electrostatically attracted to the conveyer surface 54.

Thus, the sheet P fed out from the sheet feeding unit 10 is conveyed in the conveyance direction A, while being attracted to the conveyor surface 54 by the attraction force from the media attracting platen 60. The sheet P having been conveyed while being attracted to the conveyor surface 54 then successively passes an area under the four ink-jet heads 2 in which area the sheet P faces the ejection faces 2*a*. At this time, the controller 100 controls the ink-jet heads 2 so that the ink-jet heads 2 eject ink of various colors towards the sheet P passing the area. Through this, a desirable color image is formed on the sheet P.

A jam occurs, when a sheet P conveyed to the ink-jet heads 2 while being attracted to the conveyor surface 54 contact the ink jet heads 2. In view of this, the casing 1*a* is provided with a door that can be manually opened or closed to allow removal of the clogging sheet P from the conveyance mechanism 50 when the jam occurred. Further, there is provided a door-open/close sensor 102 which senses opening or closing of the door. The result from this door-open/close sensor 102 is transmitted to the controller 100.

Figure 4:
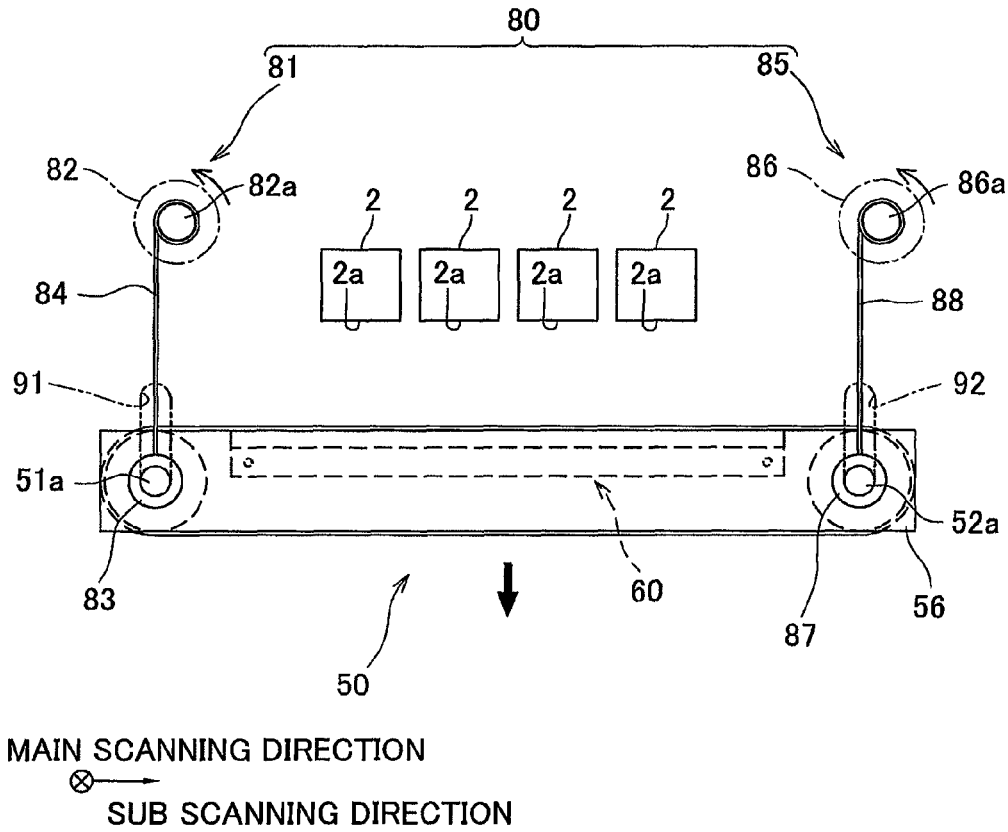
FIG. 4 is a schematic side view illustrating an elevation mechanism which elevates the conveyance mechanism.

Further, as illustrated in FIG. 4, the conveyance mechanism 50 is moved upward or downward relative to the ink-jet heads 2, by the elevation mechanism 80. The conveyance mechanism 50 therefore moves between a printing position illustrated in FIG. 1 where the conveyance mechanism 50 is closely disposed to the ink-jet head 2 and a retracted position which is lower than the printing position. The printing position is a position for printing an image on the sheet P with ink ejected from the ink-jet heads 2. The retracted position is a position in which the spacing distance between each ejection face 2*a* and the conveyance mechanism 50 is longer than the spacing distance in the printing position.

The elevation mechanism 80 includes an elevation unit 81 for elevating the belt roller 51, and an elevation unit 85 for elevating the belt roller 52, as illustrated in FIG. 4. The elevation unit 81 includes an elevation motor 82, two rings 83, and wires 84 serving as linking members. The rings 83 are provided outside of the support plates 55 and 56, nearby two ends of the axis 51*a* of the belt roller 51, and rotatably support the axis 51*a*. Each wire 84 has one end thereof fixed to the upper end of associated one of the rings 83. The other end of the wire 84 is fixed to and wound around the axis 82*a* of the elevation motor 82. Further, inside the casing 1*a* are provided guide holes 91 which guide the upward and downward movement of the axis 51*a* of the belt roller 51. Each of these guide holes 91 is provided so as to face an end of the axis 51*a* of the belt roller 51. The guide holes 91 are formed on the main body frame extending in the upright direction, and extend downwards with its upper end positioned at the position of the axis 51*a* when the conveyance unit 50 is disposed in the printing position.

Further, the elevation unit 85 also includes an elevation motor 86, two rings 87, and wires 88. The ring 87 are provided outside of the support plates 55 and 56, nearby two ends of the axis 52*a*, and rotatably support the axis 52*a*. Each wire 88 has one end thereof fixed to the upper end of associated one of the rings 87. The other end of the wire 84 is fixed to and wound around the axis 86*a* of the elevation motor 86. Further, inside the casing 1*a* are provided guide holes 92 which guide the upward and downward movement of the axis 52*a* of the belt roller 52. Each of these guide holes 92 is provided so as to face an end of the axis 52*a* of the belt roller 52. The guide holes 92 are also formed on the main body frame extending in the upright direction, and extend downwards with its upper end positioned at the position of the axis 52*a* when the conveyance mechanism 50 is disposed in the printing position.

With this, when the two elevation motors 82 and 86 are driven at the same time under control of the controller 100 and the axes 82*a* and 86*a* rotate counter clockwise in FIG. 4, the wires 84 and 88 are unwound from the axes 82*a* and 86*a*. This causes the conveyance mechanism 50 to move downward along the guide holes 91 and 92. In other words, the conveyance mechanism 50 moves from the printing position to the retracted position. On the other hand, when the axes 82*a* and 86*a* rotate clockwise in FIG. 4 under control of the controller 100, the wires 84 and 88 are wound around the axes 82*a* and 86*a*, respectively. This causes the conveyance mechanism 50 to move upward along the guide holes 91 and 92. In other words, the conveyance mechanism 50 moves from the retracted position to the printing position. Note that the movement of the conveyance mechanism 50 from the printing position to the retracted position is performed when the maintenance operation is performed with respect to the ink-jet heads 2. The present embodiment deals with a case where the conveyance mechanism 50 is moved upwardly or downwardly relative to the ink-jet heads 2 by the elevation mechanism 80. The present invention however is not limited to this. For example, the elevation mechanism 80 may move the ink-jet heads 2 upwardly or downwardly relative to the conveyance mechanism 50. Further, the elevation mechanism may move both the ink-jet heads 2 and the conveyance mechanism 50 upwardly or downwardly so as to put the ink-jet heads 2 and the conveyance mechanism 50 closely to or far from each other.

Return to FIG. 1 now. A separating member 9 is provided immediately downstream of the conveyance mechanism 50 relative to the conveyance direction A. The separating member 9 separates the sheet P from the conveyor surface 54, by having the leading end of the separating member 9 get between the sheet P and the conveyance belt 53. Note that, by the time the leading end of the sheet P reaches the separating member 9, the attraction force between the conveyor surface 54 and the sheet P is weakened. The sheet P therefore is separated from the conveyor surface 54 by the separating member 9.

Four feed rollers 21*a*, 21*b*, 22*a*, and 22*b* are provided along the conveyance path between the conveyance mechanism 50 and the sheet output unit 15. Between the feed rollers 21*a* and 21*b* and the feed rollers 22*a* and 22*b* is disposed a conveyance guide 18. The feed rollers 21*b* and 22*b* are driven and rotated by a feed motor controlled by the controller 100. In this structure, the feed rollers 21*b* and 22*b* are rotated under control of the controller 100. The sheet P output from the conveyance mechanism 50 is fed upward in FIG. 1 through the conveyance guide 18, while being sandwiched between the feed rollers 21*a* and 21*b*. The sheet P sandwiched between the feed rollers 22*a* and 22*b* is then fed to the sheet output unit 15. Note that the feed rollers 21*a* and 22*a* are driven rollers and rotate with the conveyance of the sheet.

Figure 5A:
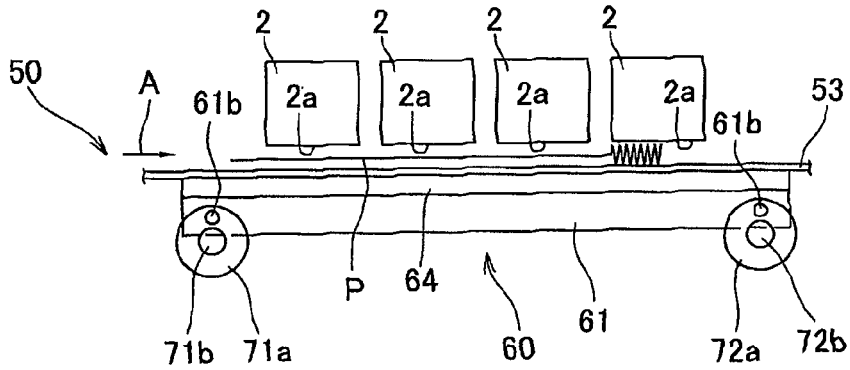
FIGS. 5A to 5C are flow-charts each showing a maintenance operation of ink-jet printer of the first embodiment, according to the present invention.

Next, the following describes, with reference to FIG. 5, the maintenance operation in which maintenance is performed to the media attracting platen 60 and the conveyance belt 53. For example, while the sheet P attracted to the conveyance belt 53 is conveyed, the leading end of the sheet P may contact the ejection face 2*a* of the ink-jet head 2 at the most downstream position, thus causing a jam of the sheet P, as illustrated in FIG. 5A. The controller 100 determines if a jam occurred, based on a result from the sheet detection sensor 101. Whether or not the jam occurred may be determined based on the operation status of the belt roller 51 or 52, instead of or in addition to the result given by the sheet detection sensor 101. If the controller 100 determines that the jam occurred, the controller 100 controls each unit to start the maintenance operation. First the controller 100 controls the conveyance mechanism 50 to stop the conveyance of the sheet P.

Figure 5B:
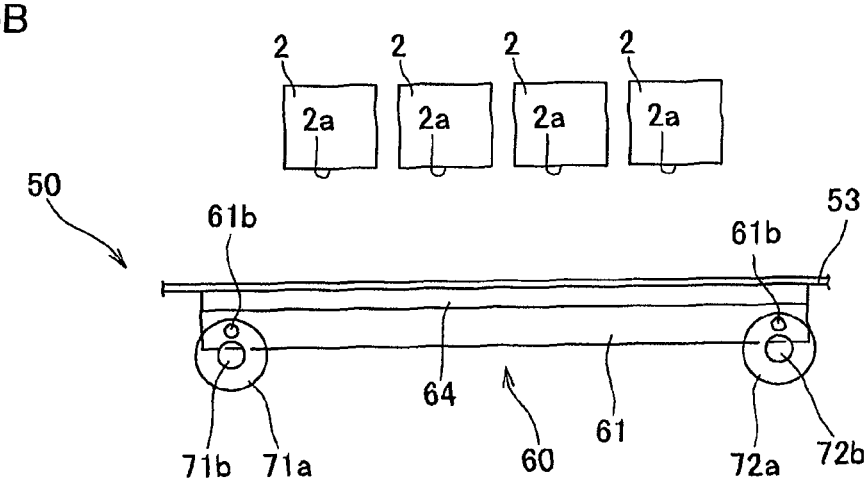

Next, the controller 100 controls the elevation mechanism 80 to move the conveyance mechanism 50 from the printing position to the retracted position, as illustrated in FIG. 5B. Further, the controller 100 stops application of the voltage to the pair of electrodes 62 and 63. Then, a user is able to open the door provided to the casing 1*a* and remove the jammed sheet P from the conveyance belt 53. The controller 100 determines whether the door is opened or not based on the result given by the door-open/close sensor 102.

Figure 5C:
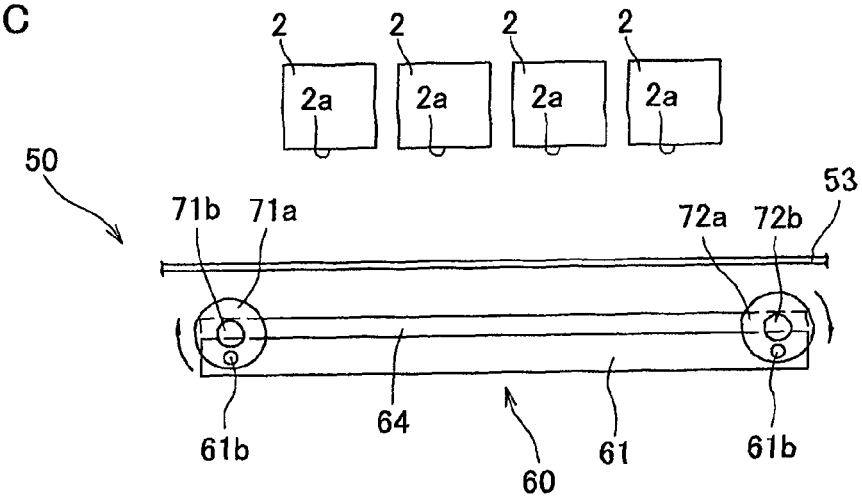

Next, the controller 100 determines whether or not the user has closed the door based on the result given by the door-open/close sensor 102. Further, the controller 100 determines whether or not the sheet P has been removed from the conveyance belt 53, based on the result given by the sheet detection sensor 101. If it is determined that the sheet P has not been removed, the controller 100 reports the user through a display or the like that the sheet P still remains. When it is determined that the sheet P is removed and that the door has been closed, the controller 100 controls the moving mechanism 70 to cause the discs 71*a* and 72*a* to make one rotation. That is, as illustrated in FIG. 5C, the media attracting platen 60 is descended from the approximated position to the departed position, and the media attracting platen 60 is brought back to the approximated position. Thus, the maintenance operation performed when the sheet P jams is completed. The controller 100 then controls the conveyance mechanism 50 and the ink-jet heads 2, to start conveyance of a new sheet P from the sheet feeding unit 10, and perform printing on the new sheet P. Whether or not a sheet has been removed may be determined, simply by determining whether or not the door is opened or closed, based on the result given by the door-open/close sensor 102, instead of determining the same separately based on the result given by the sheet detection sensor 101.

As is understood from the above, when conveyance of a sheet P stops while the sheet P is attracted to the conveyance surface, the ink-jet printer 1 of the present embodiment stops application of voltage to the pair of electrodes 62 and 63 and change the spacing distance between the media attracting platen 60 and the conveyance belt 53 from the first distance to the second distance. This reduces the charge accumulated on the surfaces of the conveyance belt 53 and the media attracting platen 60 facing each other. In other words, the conditions of the media attracting platen 60 and the conveyance belt 53 are brought back to the conditions before the accumulation of the charge. Therefore, the initial running load to resume running the conveyance belt 53 is reduced. This prevents the conveyance belt 53 from being stretched and damaged, or prevents the conveyance belt 53 from slipping relative to the belt roller 52.

The first embodiment deals with a case where application of the voltage to the pair of electrodes is stopped after the conveyance of the sheet P attracted to the conveyance surface is stopped. The application of voltage however does not have to be stopped. In this case too, the charge accumulated on the conveyance belt 53 and the media attracting platen 60 is reduced, because the spacing distance between the conveyance belt 53 and the media attracting platen 60 changes from the first distance to the second distance. Therefore, the initial running load to resume running the conveyance belt 53 is reduced, as in the above mentioned case. In cases where the conveyance belt 53 stops running for some reason while the sheet P is not attracted to the conveyance surface, and the conveyance belt 53 and the media attracting platen 60 stick to each other, the change of the spacing distance between the media attracting platen 60 and the conveyance belt 53 from the first distance to the second distance reduces the charge accumulated between these two members. Therefore, the same effect is achievable.

Further, in the first embodiment, the moving mechanism 70 moves the media attracting platen 60 from the approximated position to the departed position, while keeping the top surface of the media attracting platen 60 horizontal. However, it is possible to move the media attracting platen 60 from the approximated position to the departed position by tilting the media attracting platen 60 as illustrated in FIG. 6. This first alternative form of the first embodiment includes a pivoting mechanism (transport unit) 170 at the upstream end of the media attracting platen 60 relative to the conveyance direction A. The pivoting mechanism 170 includes an axis 171 whose two ends are rotatably supported by the pair of support plates 55 and 56, respectively; a fixed member 172 formed in a portion of the axis 171 facing the media attracting platen 60, and a drive mechanism which applies a rotation force to the axis 171 under control of the controller 100. The fixed member 172 is fixed to the upstream end of the media attracting platen 60.

Figure 6A:
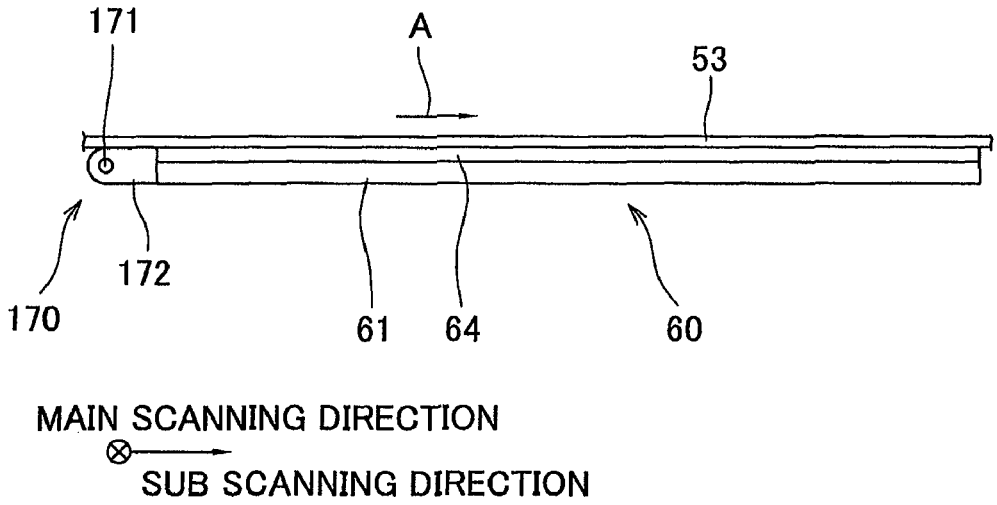
FIGS. 6A and 6B are partial enlarged views each illustrating a first alternative form which is an alternative form of the conveyance mechanism of the first embodiment, according to the present invention.
Figure 6B:
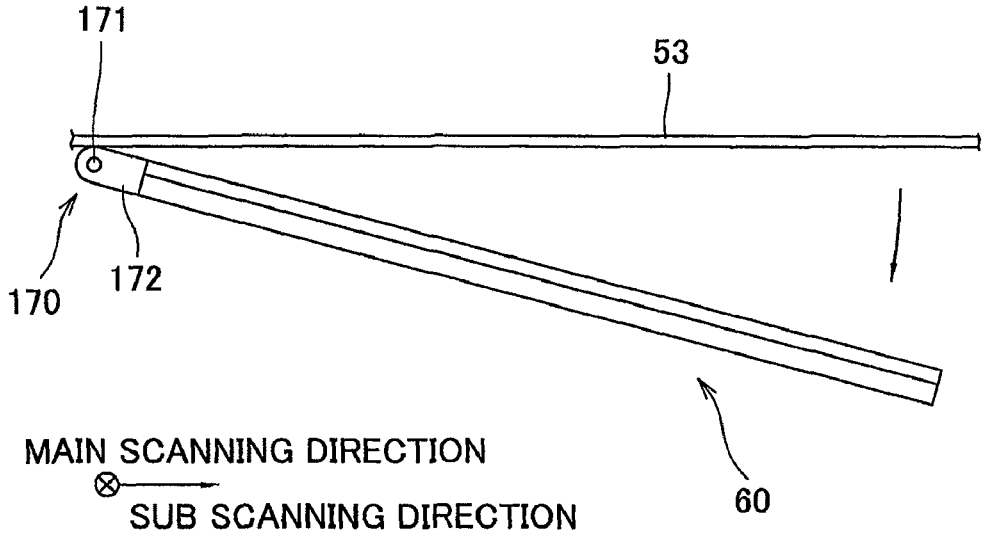

In this structure, for example, when the axis 171 rotates 15° from the conditions illustrated in FIG. 6A, under control of the controller 100, the media attracting platen 60 pivots on from the approximated position illustrated in FIG. 6A to the departed position illustrated in FIG. 6B where the top surface of the media attracting platen 60 is tilted. At this point, the moving speed of the media attracting platen 60 is lower at its upstream end and is higher at its downstream end. Therefore, the conveyance belt 53 is released from the media attracting platen 60, successively from the portion of the conveyance belt 53 facing the downstream end of the media attracting platen 60. Therefore, the conveyance belt 53 is smoothly separated from the media attracting platen 60, without significant load on the entire portion of the conveyance belt 53 attracted to the media attracting platen 60.

When the axis 171 rotates 15° from the above condition of FIG. 6B under control of the controller 100, the media attracting platen 60 moves back from the departed position to the approximated position. When the media attracting platen 60 is in the approximated position, the spacing distance between the media attracting platen 60 and the conveyance belt 53 is substantially the same as the first distance of the first embodiment. In the present alternative form, however, the second distance is a spacing distance between the upstream end of the media attracting platen 60 and the conveyance belt 53. Thus, while the media attracting platen 60 is in the departed position, the entire top surface of the media attracting platen 60 is at least the second distance away from the conveyance belt 53. If a charge is accumulated between the media attracting platen 60 and the upper loop of the conveyance belt 53 while the spacing distance is the first distance, that charge accumulated between these two members is brought back to the condition before the accumulation, by pivoting on the media attracting platen 60 from the approximated position to the departed position so that the spacing distance therebetween is the second distance. Thus, the effect achieved by the foregoing first embodiment is also achievable with this alternative form. The fixed member 172 of the pivoting mechanism 170 in the present alternative form is fixed to the upstream end of the media attracting platen 60 relative to the conveyance direction A. However, the fixed member 172 may be fixed to an end of the media attracting platen 60 relative to the main scanning direction. This form also achieves the same effect mentioned above.

Next, the following describes an ink jet printer of a second embodiment, according to the present invention, with reference to FIG. 7 and FIG. 8. The ink jet printer of the present embodiment includes a media attracting platen 260 and a lifting mechanism (transport unit) 270 which lifts the conveyance belt 53. The second embodiment is substantially the same as the first embodiment, except in that the lifting mechanism 27 lifts up the conveyance belt 53 in the maintenance operation. The members and parts that are identical to those described in the first embodiment are given the same reference numerals and no further explanation is provided for those members and parts.

Figure 7A:
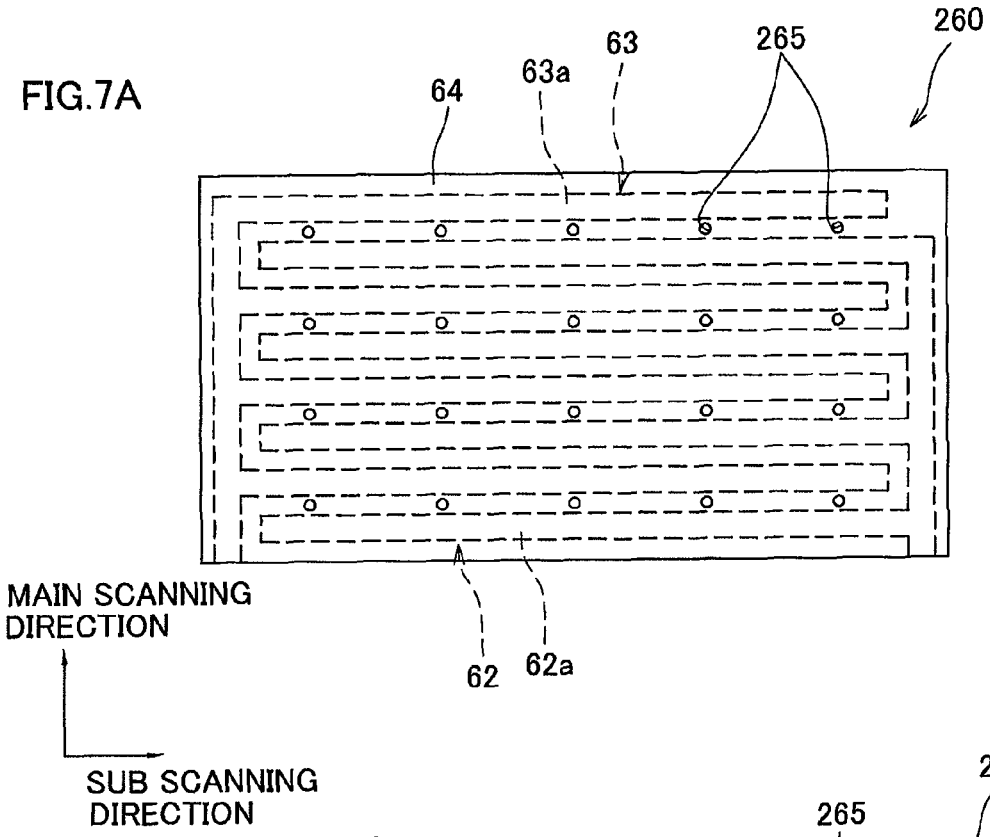
FIGS. 7A to 7C are schematic diagrams each illustrating a media attracting platen and a lifting mechanism of an ink-jet printer of a second embodiment, according to the present invention.

The media attracting platen 260 is structured substantially in the same manner as the foregoing media attracting platen 60, except in that a plurality of holes 265 are formed as illustrated in FIG. 7. These holes 265 are aligned in the sub scanning direction between lengthy parts 62*a* and 63*a* of a pair of comb-shaped electrode 62 and 63, as illustrated in FIG. 7A. Further, each of the holes 265 continuously penetrates the base member 61 and the protection film 64 in a direction perpendicular to the ejection face 2*a*. Further, the media attracting platen 260 is fixed to a pair of support plates 55 and 56, and is not moveable.

Figure 7B:
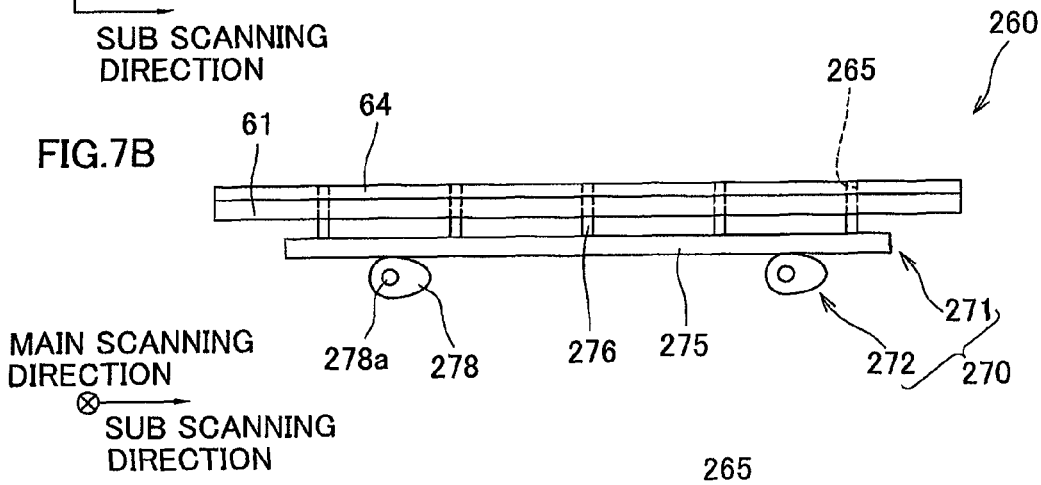
Figure 7C:
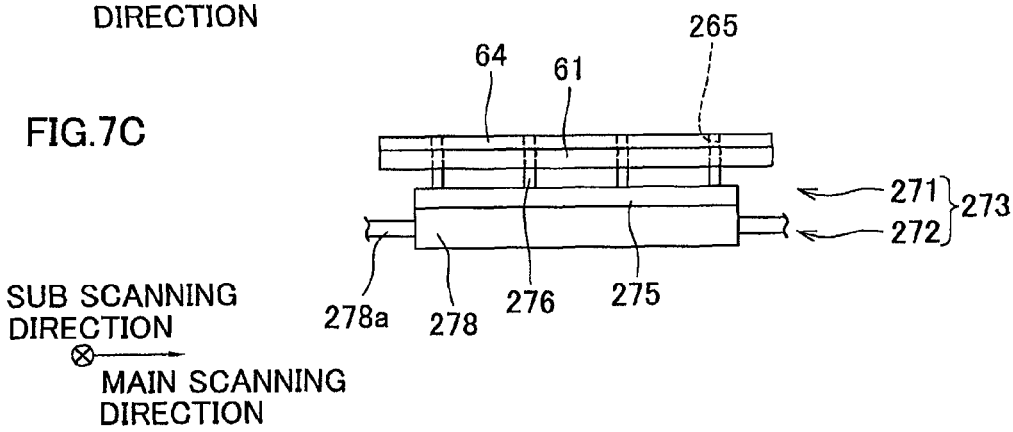

The lifting mechanism 270 includes a member 271 capable of passing the holes 265, and a displacement mechanism 272 which displaces the member 271, as illustrated in FIG. 7B and FIG. 7C.

This member 271 has a plate-like member 275 and a plurality of stick-like members 276. The plate-like member 275 is slightly smaller than the media attracting platen 260 in plane view, and is disposed in such a manner that the media attracting platen 260 is sandwiched between the conveyance belt 53 and the plate-like member 275. The plurality of stick-like members 276 are formed upright on the top surface of the plate-like member 275. Each of these stick-like members 276 is disposed so as to face a hole 265 of the plate-like member 275, and shaped in such a manner as to pass the hole 265. Further, the stick-like members 276 are longer than the holes 265.

The displacement mechanism 272 includes two cams 278, and a drive mechanism which exerts a rotation force to the axes 278*a* of the cams 278 under control of the controller 100. As illustrated in FIG. 7C, each of the cams 278 has the length which is substantially the same as the length of the plate-like member 275 in the main scanning direction. Further, two ends of the axis 278*a* of the cam 278 is rotatably supported by the pair of support plates 55 and 56.

Figure 8A:
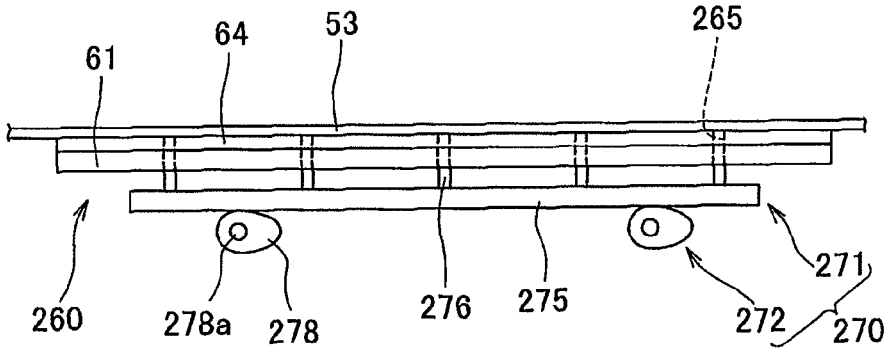
FIGS. 8A and 8B are flow-charts each illustrating the maintenance operation of the ink-jet printer of the second embodiment, according to the present invention.
Figure 8B:
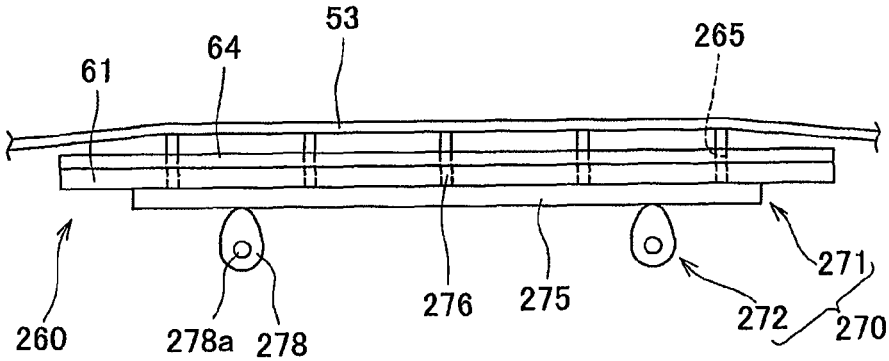

As illustrated in FIG. 8A, the displacement mechanism 272 is usually positions the member 271 in the approximated position so that the spacing distance between the conveyance belt 53 and the media attracting platen 260 is the same as the first distance of the first embodiment. During this condition, the plate-like member 275 of the present embodiment is positioned so that the upper ends of the stick-like members 276 are at the same level as the top surface of the media attracting platen 260. However, the upper ends of the stick-like members 265 may be disposed at any given position, provided that the upper ends do not project from the media attracting platen 260 towards the conveyance belt 53. In the maintenance operation for recovering from the state where the media attracting platen 260 and the conveyance belt 53 stick to each other, the controller 100 controls the drive mechanism so that the drive mechanism rotates the cam 278 90° counter clockwise from the position of FIG. 8A, as illustrated in FIG. 8B. The plate-like member 275 is then lifted up. With the lifting of the plate-like member 275, the stick-like members 276 project from the media attracting platen 260 and abut the conveyance belt 53, thus pushing the conveyance belt 53 upward. Thus, the member 271 is positioned at the departed position, and the spacing distance between the conveyance belt 53 and the media attracting platen 260 is the same as the second distance of the first embodiment. With this, when a charge is accumulated between the media attracting platen 260 and the upper loop of the conveyance belt 53 while the spacing distance is the first distance, the charge between these two members is promptly brought back to the condition before the accumulation, simply by changing the spacing distance to the second distance. Therefore, the effect which is the same as that of the first embodiment is achievable. Additionally, the conveyance belt 53 is pushed upward with a relatively simple structure.

Figure 9:
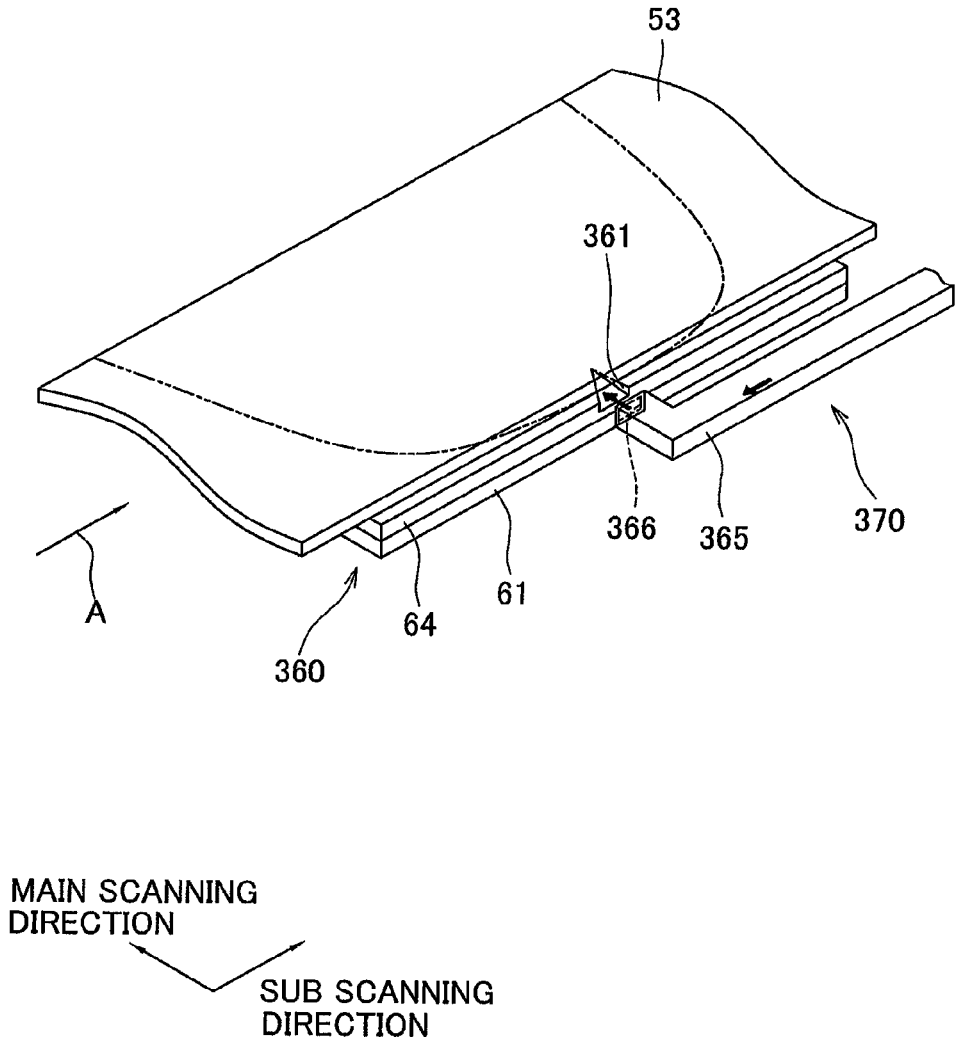
FIG. 9 is a partial perspective view illustrating a second alternative form which is an alternative form of the conveyance mechanism of the second embodiment, according to the present invention.

In the second embodiment, the spacing distance between the conveyance belt 53 and the media attracting platen 260 is changed from the first distance to the second distance by displacing the member 271 in such a manner as to have the stick-like members 276 abut the conveyance belt 53. However, the conveyance belt 53 may be separated from the media attracting platen by other methods. As illustrated in FIG. 9, an ink-jet printer of a second alternative form related to the second embodiment includes: a media attracting platen 360 similar to the media attracting platen 60 of the first embodiment; an air blowing mechanism (transport unit) 370 which blows the air between the conveyance belt 53 and the media attracting platen 360. The air blowing mechanism 370 separates the conveyance belt 53 from the media attracting platen 260 by blowing the air between the conveyance belt 53 and the media attracting platen 360.

The air blowing mechanism 370 has a blower controlled by the controller 100 and a conduit 365 for guiding the air from the blower. The conduit 365 is provided so that the air-outlet port 366 is disposed in a position to face a portion of the media attracting platen 360 in the middle relative to the sub scanning direction, which portion is at an end of the media attracting platen 360 in the main scanning direction.

The media attracting platen 360 has an air-inlet port 361 which is formed in a position to face the air-outlet port 366. The air-inlet port 361 has a U-shape with its opening facing up. Further, the air-inlet port 361 is tapered (the width of the air-inlet port 361 relative to the sub scanning direction is gradually reduced) from one end of the media attracting platen 360 relative to the main scanning direction towards the middle area. Substantially a half of the air-inlet port 361 overlaps the conveyance belt 53 in the upright direction. This facilitates supplying of the air blown out from the air-outlet port 366 to the entire area circled by the chain double-dashed line of FIG. 9 which is between the conveyance belt 53 and the media attracting platen 360. In other words, the blown-out air is supplied between the entire conveyance belt 53 and the media attracting platen 360 in such a manner that the air is distributed to substantially the entire area between the conveyance belt 53 and the media attracting platen 360. This allows the spacing distance between the conveyance belt 53 and the media attracting platen 360 to be effectively changed.

In the maintenance operation for recovering from the state where the media attracting platen 360 and the conveyance belt 53 stick to each other, the controller 100 controls the blower to blow out the air from the air-outlet port 366. This blown-out air is successively supplied between the conveyance belt 53 and the media attracting platen 360, in a direction from the air-inlet port 361 towards the other end of the media attracting platen 360 in the main scanning direction. This supplied air pushes the conveyance belt 53 upwards, and the spacing distance between the conveyance belt 53 and the media attracting platen 360 changes from the first distance to the second distance. If a charge is accumulated between the media attracting platen 360 and the upper loop of the conveyance belt 53 while the spacing distance is the first distance, that charge accumulated between these two members is promptly brought back to the condition before the accumulation, by changing the spacing distance therebetween to the second distance. Therefore, the effect which is the same as that of the first embodiment is achievable. Further, since there is no need for a member to directly contact the conveyance belt 53 to change the spacing distance between the conveyance belt 53 and the media attracting platen 360, the conveyance belt 53 is kept from being damaged.

As illustrated in FIG. 10, an ink-jet printer of a third alternative form related to the second embodiment includes: a media attracting platen 460 similar to the media attracting platen 60 of the first embodiment, and a lifting mechanism (transport unit) 470. The media attracting platen 460 is fixed to the pair of support frames 55 and 56 and is not moveable. At the upstream end and the downstream end of the media attracting platen 460 relative to the conveyance direction A are formed slopes 460*a* and 460*b*.

The lifting mechanism 470 includes: a roller (separator) 471; a roller moving mechanism (separator moving mechanism) 472 which moves the roller 471 through an area between the media attracting platen 460 and the conveyance belt 53, from one side of the media attracting platen 460. The roller 471 is disposed so that the axis 471*a* thereof extends in the main scanning direction. The length of the roller 471 in the main scanning direction is substantially the same as that of the media attracting platen 460.

The roller moving mechanism 472 includes: a pair of support members 473 which rotatably support the roller 471; and a moving mechanism 474 which moves the pair of support members 473 in the sub scanning direction. The pair of support members 473 is disposed so as to sandwich the conveyance belt 53 in the main scanning direction. Each support member 473 includes: a first link member 473*a* which supports the axis 471*a* of the roller 471; and a second link member 473*b* whose one end is rotatably connected to the first link member 473*a* and whose other end is fixed to a timing belt 474*c* of the moving mechanism 474. The second link member 473*b* has a projection 473*c* projecting in the main scanning direction. The projection 473*c* is disposed in a guide groove 455 formed on the pair of support frames 55 and 56. Each guide groove 455 extends in the sub scanning direction. Note that the support frames 55 and 56 of the present alternative form are the same as those of the first embodiment except in that the support frame 55 and 56 of the present alternative form are extended in the vertical direction. The guide groove 455 is formed in this extended portion of the support frames 55 and 56.

The moving mechanism 474 includes a pair of rollers 474*a*, a pair of rollers 474*b*; timing belts 474*c* each of which looped around one of the rollers 474*a* and one of the rollers 474*b*; and a drive mechanism that exerts a rotation force to the pair of rollers 474*b*. The drive mechanism includes: a drive motor controlled by the controller 100; and a transmission mechanism which transmits the rotation force from the drive motor to the pair of rollers 474*b* at the same time. One of the rollers 474*a* and one of the rollers 474*b* are rotatably supported on the support frame 55, and the other one of the rollers 474*a* and the other one of the rollers 474*b* are rotatably fixed on the support frame 56. The spacing distance between one of the rollers 474*a* and corresponding one of the rollers 474*b* relative to the sub scanning direction is longer than the length of the media attracting platen 460 relative to the sub scanning direction, but shorter than the distance between the belt rollers 51 and 52.

Figure 10A:
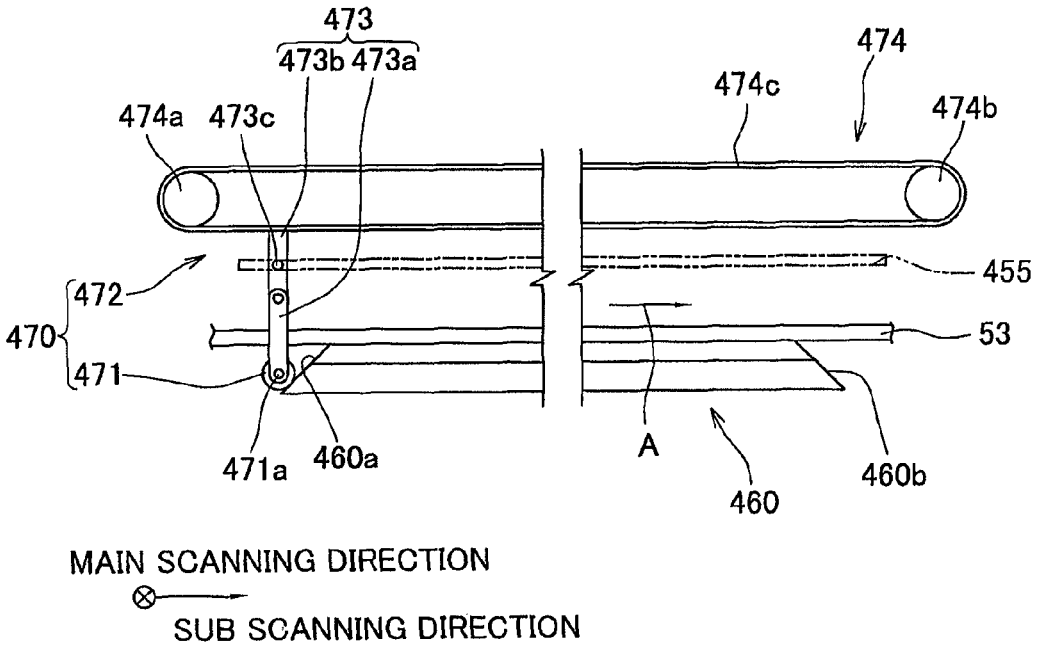
FIGS. 10A and 10B are schematic side views each illustrating a third alternative form which is an alternative form of the conveyance mechanism of the second embodiment, according to the present invention.
Figure 10B:
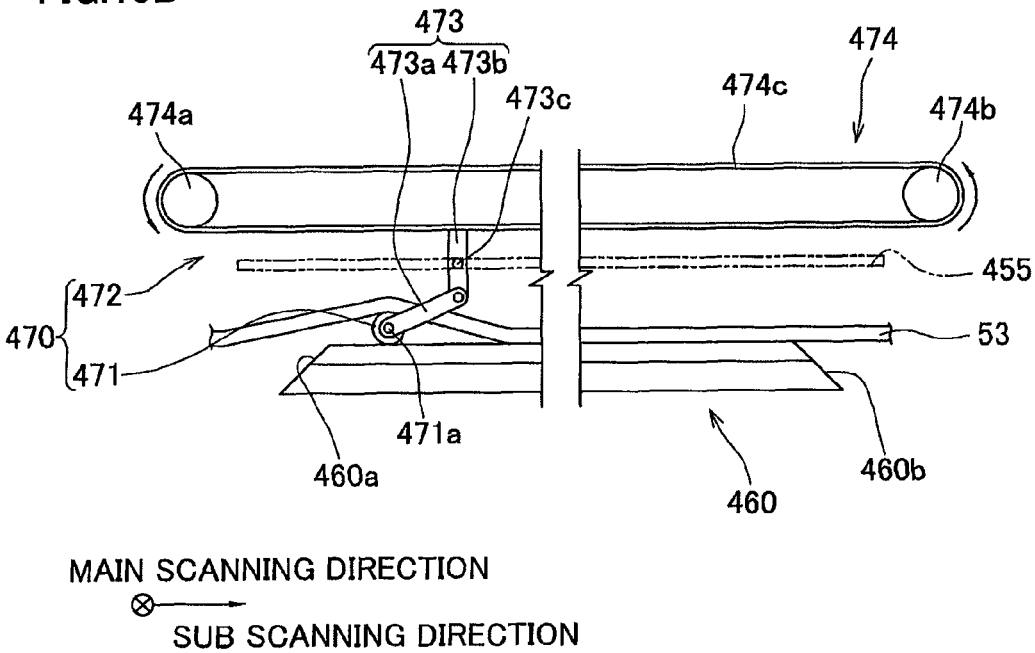

As illustrated in FIG. 10A, the roller moving mechanism 472 usually positions the roller 471 so that the roller 471 contacts the slope 460*a* while being apart from the conveyance belt 53. The spacing distance between the conveyance belt 53 and the media attracting platen 460 is similar to the first distance of the first embodiment. In the maintenance operation for recovering from the state where the media attracting platen 460 and the conveyance belt 53 stick to each other, the controller 100 controls the drive mechanism to move the roller 471 in the conveyance direction A, as illustrated in FIG. 10B. Specifically, the timing belts 474*c* are run counter clockwise until the roller 471 moves from the slope 460*a* to the slope 460*b*. At this time, the roller 471 always contacts the media attracting platen 460 while the roller 471 moves in the conveyance direction A. The first link member 473*a* is tilted by rotating about one end of the second link member 473*b*. Further, the roller 471 travels between the conveyance belt 53 and the media attracting platen 460 and the conveyance belt 53 and the media attracting platen 460 are partially and successively separated by a spacing distance corresponding to the second distance of the first embodiment. If a charge is accumulated between the media attracting platen 460 and the upper loop of the conveyance belt 53 while the spacing distance is the first distance, the spacing distance is successively changed to the second distance. Therefore, it is possible to effectively reduce the pulling force to be applied to the conveyance belt 53. Further, the charge accumulated in the area where the spacing distance is changed is promptly brought back to the condition before the accumulation. Therefore, the initial running load to resume running the conveyance belt 53 is reduced.

Preferable embodiments of the present invention have been thus described. The present invention however is not limited to these embodiments, and may be altered in various ways. For example, the electrodes 62 and 63 of the media attracting platen in the above embodiments and the alternative forms may have lengthy parts which extend in the main scanning direction, and these lengthy parts may be alternately disposed in the sub scanning direction. Further, the second distance may be longer than the first distance but shorter than a distance by which charge is not accumulated in the gap between the conveyance belt and the media attracting platen when the voltage is applied to the electrodes. Since the spacing distance is longer than the first distance, the charge accumulated between the conveyance belt and the media attracting platen is reduced. Therefore, effects similar to those described above are achievable.

Further, in the second embodiment, a plurality of holes 265 are formed on the media attracting platen 260. However, the media attracting platen 260 may have only one hole. In this case, the number of stick-like members 276 is also made one to match the number of the holes. Further, the present invention is also applicable to recording apparatuses adopting a record head other than an ink-jet head.

What is claimed is:

1. A recording apparatus, comprising:

a record head having an image formation surface which forms an image on a recording medium;

a conveyance belt which conveys the recording medium to a position to face the image formation surface;

a media attracting platen having a pair of electrodes, which is disposed in such a manner that the conveyance belt is sandwiched between the media attracting platen and the image formation surface;

a voltage supply unit which applies a voltage to the pair of electrodes so as to attract the recording medium to the conveyance belt; and a transport unit which moves at least one of the conveyance belt and the media attracting platen so that a spacing distance between the conveyance belt and the media attracting platen is selectively switched between a first distance and a second distance longer than the first distance.

2. A recording apparatus according to claim 1, wherein the transport unit moves the media attracting platen so that the spacing distance changes from the first distance to the second distance.

3. A recording apparatus according to claim 2, wherein the transport unit pivots on the media attracting platen about one end of the media attracting platen relative to the conveyance direction of the recording medium or one end of the media attracting platen relative to a direction perpendicular to the conveyance direction.

4. A recording apparatus according to claim 1, wherein the transport unit lifts up a portion of the conveyance belt facing the media attracting platen so that the spacing distance changes from the first distance to the second distance.

5. A recording apparatus according to claim 4, wherein:

the media attracting platen has a hole penetrating perpendicularly to the image formation surface; and the transport unit includes: a member capable of passing the hole, which is disposed so as to sandwich the media attracting platen between the member and the conveyance belt; and a displacement unit which displaces the member between a position where the spacing distance is the first distance, and a position where the member project from the media attracting platen so that the spacing distance becomes the second distance.

6. A recording apparatus according to claim 4, wherein the transport unit includes a blowing mechanism which blows the air between the conveyance belt and the media attracting platen so that the spacing distance changes from the first distance to the second distance.

7. A recording apparatus according to claim 6, wherein the media attracting platen has an air inlet port which guides the air blown out from the blowing mechanism between the conveyance belt and the media attracting platen.

8. A recording apparatus according to claim 4, wherein the transport unit includes: a separator capable of separating the conveyance belt from the media attracting platen; and a separator moving mechanism which moves the separator from one end to the other end of the area so that the spacing distance partially and successively changes from the first distance to the second distance.

9. A recording apparatus according to claim 1, wherein:

the pair of electrodes each includes a plurality of portions which extend in an in-plane direction of the image formation surface; and the portions of one of the electrodes and the portions of the other one of the electrodes are alternately disposed.

10. A recording apparatus according to claim 1, wherein:

the first distance is a distance whereby accumulation of a charge on surfaces of the conveyance belt and the media attracting platen is possible by applying a voltage to the pair of electrodes; and the second distance is a distance whereby the charge accumulated on the surfaces of the conveyance belt and the media attracting platen while the spacing distance is the first distance is brought back to a state before the charge is accumulated.

11. A recording apparatus according to claim 1, further comprising:

a controller which controls the transport unit so that, when conveyance of the recording medium is stopped while the recording medium is on the conveyance belt, the spacing distance is changed from the first distance to the second distance before running the conveyance belt again.

12. A recording apparatus according to claim 11, wherein the controller controls the transport unit so that the spacing distance is changed from the first distance to the second distance after the recording medium is removed from the conveyance belt.

13. A recording apparatus according to claim 12, further comprising:

a medium detection sensor which senses whether or not the recording medium is on the conveyance belt, wherein the controller determines whether or not the recording medium is removed from the conveyance belt based on a result given by the medium detection sensor.

14. A recording apparatus according to claim 12, further comprising;

a casing having a door which is opened or closed for a purpose of removing a recording medium on the conveyance belt; and a door-open/close sensor which senses opening or closing of the door, wherein the controller determines whether or not the recording medium is removed from the conveyance belt, based on a result given by the door-open/close sensor.

* * * * *